US007510191B1

(12) United States Patent
Schlumbrecht

(10) Patent No.: US 7,510,191 B1
(45) Date of Patent: Mar. 31, 2009

(54) RIVER CARD POKER

(76) Inventor: T. Christian Anthony Schlumbrecht, 1425 N. Queens Rd., Los Angeles, CA (US) 90069

( * ) Notice: Subject to any disclaimer, the term of this patent is extended or adjusted under 35 U.S.C. 154(b) by 312 days.

(21) Appl. No.: 11/397,353

(22) Filed: Apr. 3, 2006

Related U.S. Application Data

(63) Continuation-in-part of application No. 10/470,644, filed on Nov. 2, 2004, now abandoned, which is a continuation-in-part of application No. 10/390,931, filed on Mar. 19, 2003, now abandoned.

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 4,836,553 A * 6/1989 Suttle et al. ..... 273/292
4,861,041 A 8/1989 Jones et al.
4,948,134 A 8/1990 Suttle et al.
5,078,405 A 1/1992 Jones et al.
5,288,081 A 2/1994 Breeding
5,382,025 A 1/1995 Sklansky et al.
5,417,430 A 5/1995 Breeding
5,494,295 A 2/1996 Potter et al.
5,810,354 A 9/1998 Banyai
5,901,958 A 5/1999 Andrews
5,951,012 A 9/1999 Feola
5,964,464 A 10/1999 Jones
5,975,529 A 11/1999 de Keller
6,196,547 B1 3/2001 Pascal et al.
6,206,373 B1 3/2001 Garrod
6,279,910 B1 8/2001 de Keller
6,283,474 B1 9/2001 de Keller
6,332,614 B1 12/2001 Hesse
6,375,189 B1 4/2002 Jones
6,379,245 B2 4/2002 De Keller
6,402,150 B1 6/2002 Jones
6,435,509 B2 8/2002 Wichinsky et al.
6,443,455 B1 9/2002 Webb
6,467,771 B1 * 10/2002 deKeller ..... 273/274

(Continued)

OTHER PUBLICATIONS

Under the "Non Patent Literature Documents" section Applicant has submitted a disclosure (Exhibit A—Flop Poker) for Flop Poker which was in public use or on sale in the United States more than one year before the instant application's Nov. 2, 2004 filing date, but not more than one year before the parent application's Mar. 19, 2003 filing date.

*Primary Examiner*—Benjamin H Layno
(74) *Attorney, Agent, or Firm*—Garvey, Smith, Nehrbass & North, L.L.C.; Brett A. North

(57) ABSTRACT

A casino game comprising one or more decks of standard playing cards and a layout which designates a first area for placing player cards and a second area composed of a plurality of betting areas. The object of the game being to make a good poker hand of five cards being composed of players' individual cards in conjunction with a community card. The preferred game apparatus includes a single deck of standard playing cards and a layout that provides betting areas.

25 Claims, 2 Drawing Sheets

U.S. PATENT DOCUMENTS 6,474,646 B1 11/2002 Webb
6,503,145 B1 1/2003 Webb
6,536,768 B2 3/2003 Caputo
6,561,897 B1 5/2003 Bourbour et al.
6,575,464 B1 6/2003 Fertitta et al.
6,896,265 B1 5/2005 Schlumbrecht
2002/0008356 A1 1/2002 de Keller

* cited by examiner

RIVER CARD POKER

CROSS-REFERENCE TO RELATED APPLICATIONS

This is a continuation-in-part of U.S. patent application Ser. No. 10/470,644, filed Nov. 2, 2004, now abandoned which is incorporated herein by reference, which is a continuation-in-part of U.S. patent application Ser. No. 10/390,931, filed Mar. 19, 2003 now abandoned. Priority of both applications is hereby claimed and both are incorporated herein by reference.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND

The present invention relates to methods for playing a casino game in the nature of poker using one or more decks of conventional playing cards. More particularly, the present invention relates to a method for playing a casino wagering game, which is a variation of Seven Card Stud Poker or Down the River.

Poker is a popular game throughout the world. It combines principles of card games known for centuries in Europe but in its present form it is distinctly of American origin. There are numerous forms of poker and the main divisions are: Draw Poker, in which all of a player's cards are unknown to his opponents and Stud Poker, in which some of the player's cards are face up and others are face down.

Within the above two broad categories numerous variations exist with "Seven Card Stud" being a popular example. In "Seven Card Stud" a predetermined player makes an Ante wager and each player is dealt two cards face down and one card face up.

Each player must decide to either call the initial ante wager or fold the cards they were dealt and sit out for that hand of play. A second card face up is dealt to each player and another betting round will start with a predetermined player. All players must call the best or fold the cards they were dealt. A third card face up is dealt to each player and another betting round start. Each player must either fold or call the betting wager. A fourth card is dealt face up to each player and another betting round starts with each player either placing the bet or folding the cards. A fifth card is dealt to each player this time being dealt face down bringing the total number of player cards to seven and another betting round starts. Each player must fold or call the betting wager. At this point each player in the game will reveal all seven cards and the dealer determines the highest five-card hand on the table among the players and award that player the money from the player's pot.

In modern casinos Poker takes on one of three forms: Live or card room Poker where players compete against one another but the games are controlled and supervised by a house dealer who removes a house levy either in the form of a participation fee or as a percentage of winning hands; electronic video machines offering various forms of Poker; and Poker played as "bankers game" either where the game involves players in contest with the dealer's cards or where the object is for the players to obtain a hand based on hierarchical poker ranking. In both versions of Banker games the house enjoys a favorable advantage based on a pay table that is structured in such a way the pay-offs are not based on the true mathematical odds, to rules of pay so structured that the house has a favorable edge.

The growth in casinos has prompted the introduction of new games and variations to established games and numerous patents have been granted in this field. For example, in U.S. Pat. No. 6,070,873 (Perkins) a casino type poker game is disclosed in which the players are playing against a predetermined rank of winning hands (a banked game). Players are dealt two cards face down and a common card is placed in a designated area for all players to use if needed. The player then makes a one unit bet and is afforded an additional card face down. The player now has a five-card poker hand. In order for the player to receive a sixth card from the dealer (face down) the player would have made an insurance bet at the onset of the game before and cards were dealt out to any player. At this point if the player did not make the insurance bet and the player does not have a hand of predetermined qualifying rank the game is over and the player loses. If the player and only if the player makes the insurance bet on the onset of the game, then the player is afforded a sixth card to use to further build the chances of making a five-card winning hand. The player must make an additional bet aside from the normal betting structure to use the sixth bonus card. If the player wins, he receives a bonus payment depending on the Poker rank of his hand. Player starts with a three-card hand, two cards dealt to the specific player and one communal card for all players. The player must then pay for two additional cards at different stages in the game for a total of a five-card hand. The player can receive a sixth card only if they have played the insurance bet at the onset of the game for an additional wager. If the player did not play the insurance bet the game is over and the player does not receive a sixth card.

Various other patents disclose further variations to traditional forms of Poker (Neal) U.S. Pat. No. 5,486,005 discloses a modification of seven-card stud Poker where players do not compete against one another in the traditional sense of Poker. Each player places an initial wager. The dealer then deals a plurality of cards all cards face up to a selected area in the center of the table. Each player has the option of which one of the hands the dealer has dealt to place a wager on. The dealer then completes the deal by dealing a total number of cards amounting to at least a total of a five-card hand in which a winning hand can be found. Payers are not dealt a specific hand for the individual players, in fact all players can bet on the same poker hand if desired. All cards dealt for the players are communal cards and the players view a partial hand before making their wagers on which hand they feel has the best odds to win. The player may also place a bet if they think no hand will qualify for a pre-determined rank of winning hand.

(Rozzi et al.) U.S. Pat. No. 5,632,489 discloses a seven and a half poker game where the players compete against the dealer. Play starts by a dealer being chosen among the players by a draw of a playing card. Each player places an ante wager. Each player receives one card face down and the dealer receives one card face up. If anyone has a king of diamonds they must reveal this card to state a winning hand. If no one has the king of diamonds then play continues by each player examining the card they were dealt and seeing the dealer's card face up. They must now decide to stand or take another card. The player can win by having a face card value greater than the dealer's hand or by the dealer drawing over the seven and a half total. This game is very similar to the game "black jack" with a modified deck of playing cards.

U.S. publication No. 2003/0050106A1 (Lyfoung) demonstrates a method of playing a three-card poker style game coupled with the game baccarat where each player is dealt two cards face down. The player can choose to make a side wager before said communal card is dealt. The dealer then deals a communal card face up to complete the three-card hand. An additional wager can be made of different value but not to exceed said first wager. Both wages have different payment odds.

U.S. Pat. No. 4,836,553 and U.S. Pat. No. 4,861,041 (both Jones et al) discloses variations in which all are collectively referred to as Caribbean Stud® Poker. In the preferred method of play described in the '553 patent the game commences with each player placing a preliminary bet ("ante") at a designated location on a table layout. The house dealer deals five cards to each player and to himself; all face down except for one card in the hand of the dealer. Having viewed his hand and assessing his chances, each player can elect to retire from the round at that point (to "fold") in which event the player forfeits his amount of the ante to the house. The alternative is for the player to make an additional bet—typically prescribed by house rules to be the amount originally anted—whereupon the dealer reveals his entire hand. Provided that the dealer's hand has a poker value of at least Ace-King, the game progresses with the dealer comparing his hand to that of each pair and paying or collecting bets as appropriate. Poker hands of two pair or better are rewarded by payment of better than even odds on such hand of a winning player.

In another variation of five-card stud Poker for casino play commonly referred to as "let it ride" is described in U.S. Pat. No. 5,288,081 (breeding). Each player must place down three qual bets, whereupon the dealer deals three cards to each player and to the dealer, but this discards out of play (burns) one of the dealer's three cards, sight unseen, leaving the dealer with only two cars. Alternatively, the dealer may simply deal three cards down to each player and refrain from dealing himself a third card. At that point, each player must then decide whether to take back the first of the three wages or else to "let it ride." The dealer then turns up one of the two communal cards so that each player, now in effect in possession of four cards of the ultimate five-card hand, is put to a decision whether to withdraw the second bet from the table or to "let it ride". The third best is not retrievable when the dealer turns the second of the communal cards, play comes to an end, the players show their cards, and all bests still on the table are resolved and distributed according to the poker ranking of each bettor's hand.

In various of these games the participants are provided the option of discarding some or all of the cards which they were originally dealt. Such option can slow down a game costing it to lose momentum.

It is an object of the present invention to provide a casino variation of seven-card stud poker, which allows a player to bet against the house for a predetermined jackpot pay table.

While certain novel features of this invention shown and described below are pointed out in the annexed claims, the invention is not intended to be limited to the details specified, since a person of ordinary skill in the relevant are will understand that various omissions, modifications, substitutions and changes in the forms and details of the device illustrated an in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a new card game of River Card Poker where players compete against the house for a structured pay table providing the opportunity to increase their wager against the house during play and a quick revelation of the final game result.

River Card Poker is based on the game of poker and comprises an apparatus for playing a casino game wherein elements of skill and chance are blended. The apparatus consists of a playing surface/layout (cloth, Table top or game board) and a result selector in the form of a single deck of conventional playing cards, as is commonly used in casinos; the layout being marked out with a first area constituted by at least two or more areas, in the form of rectangles, circles, squares or other geometric shapes, situated in different areas on the table, such demarcated areas being for the placing of players cards and communal cards numbering from one to seven.

A second area on the layout designates betting areas for the reception of player's chips. Indicia for different bets, situated in the front of each player, signify the type of wagers the players make in the course of a round of the game. The betting areas may appear in the form of geometric shapes.

The method includes one or more players making a wager against the house. The players have the option to continue wagering against the house as the game progresses. If the player's hand is designated winning outcome, the player receives a payoff based on his wager(s) against the house and if the outcome is a losing outcome the player's wager(s) against the house are lost.

In River Card Poker the object of the game is to make a good poker hand. In this case the house payout schedule lists a series of poker rankings with corresponding pay-offs and the player is paid accordingly.

The game is played on a blackjack style table with a single dealer. One or more decks of standard cards can be used, the preferred embodiment being one. The player opening the betting can be rotated for each game. The game is played with chips/counters of various denominations.

In the live table game format, the players each place an initial "ante" wagers. The dealer then deals a plurality of cards face down and a plurality of cards face up to each player totaling from one to four initial cards. The dealing may be according to any one of the following formats of table 1:

TABLE 1

| Format | Player's Cards |
|---|---|
| 1 | 1 face down, 3 face up |
| 2 | 2 face down, 2 face up |
| 3 | 3 face down, 1 face up |

Each player is now afforded the option to make an additional wager of equal value of initial "ante" wager. At this point the player is afforded a five-card poker hand. This step in the game may be according to any of the following formats of table 2:

TABLE 2

| Format | Player's Cards | Communal Card |
|---|---|---|
| 1 | 1 face down, 4 face up | 1 |
| 2 | 2 face down, 3 face up | 1 |
| 3 | 3 face down, 2 face up | 1 |
| 4 | 4 face down, 1 face up | 1 |

This brings the total number of cards used by all players to six. Each player is afforded their own individual hand to place bets on. No player is allowed to participate on any other player's cards. In a preferred embodiment, at the start of each game all players can place bets of equal value in their respective "ante" positions. All "ante" bets are against the house and are for a predetermined pay table of winning hands. Players can be dealt three cards face down and one card face up. At this stage the player has a partial poker hand to make a decision on. If the player chooses to fold the ante bet is surrendered to the house and the player is out for the remainder of the game. If the player chooses to make the "Call" bet which can be equal to the "ante" bet and the player is afforded an additional card dealt face up specifically for that player's hand. The player now has a five-card poker hand to view. The player is then afforded the option to continue to play by making the final bet (River Bet) or fold and surrender the "ante" and "call" bets to the house and sit out for the remainder of the game. If the players decide to make the "River" bet, the dealer will deliver one Communal card to a designated area on the table to be used by all players still participating in the game. The players now have six cards to choose from to make the best five-card poker hand. Each player having a losing hand that does not qualify for the house pay table odds will lose all bets to the house. Any player having a winning hand by house pay table odds will win even money for the "ante" bet and house odds for the "call" bet and "river" bet.

BRIEF DESCRIPTION OF THE SEVERAL VIEWS OF THE DRAWINGS

For a further understanding of the nature, objects, and advantages of the present invention, reference should be hand to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for one skilled in the art to employ the present invention in any appropriate system, structure or manner.

The cards used in the game can be conventional playing cards divided into four sets of thirteen cards per set and each set constitutes a suit identified by separate indicia in the form of hearts, spades, diamonds and clubs. Each set in turn has nine cards bearing the numerals 2 through 10 and four court cards represented by either the letters A, K, Q & J of the titles Ace, King, Queen and Jack or pictorial representations or symbols thereof.

Figure 1:
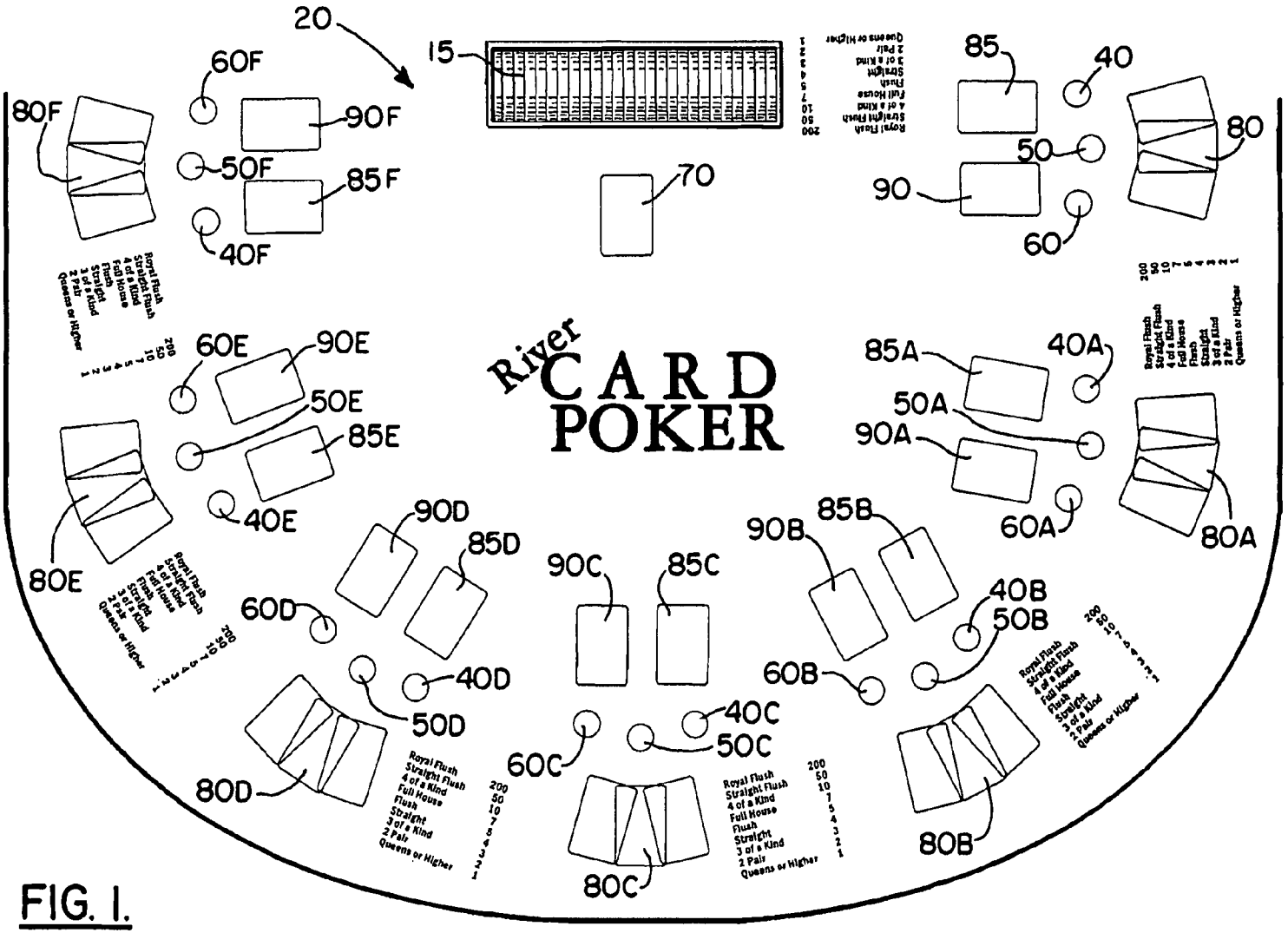
FIG. 1 is a top plan view of a preferred gaming table and layout.

Designs of modern court cards may differ but all are generally stylizations of stylizations and have their roots in the tarot pack of medieval times. Referring to FIG. 1, table 20 can have a half-moon shape and have a flat playing surface 30. The actual form of such a table (whether semi-circular, square etc.) can vary, table 20 mainly serving to support the layout at a height which is suitable for the players. Area 15 is an area for housing the chips/counters prior to being used by the players. Surface 30 provides a playing surface marked with indicia 70 to define the areas wherein the dealer positions the community card. Indicia 80, 85 and 90 to 80F, 85F and 90F are for player cards dealt by the dealer. Symbols 80 to 80F are for three cards dealt face down. Symbols 85 to 85F are for the first set of player cards to be dealt face up. Symbols 90 to 90F are for the second set of player cards to be dealt face up. A second area on the layout includes betting areas for the reception of players' chips such betting areas bearing indicia in the form of circle symbols 40 to 40F; 50 to 50F; and 60 to 60F, situated in front of each player. Symbols 40 to 40F identify the areas for "Ante" wagers. Symbols 50 to 50F identify the areas for "Call" wagers. Symbols 60 to 60F identify the areas for "River" wagers. Areas 40 to 40F; 50 to 50F; and 60 to 60F need not be stylized on the form of circles, and can be in various forms such as other geometric shapes.

In River Card Poker the object is to make a good poker hand and win from the house pay table odds. Making a five-card poker hand from the various sets of six cards the players choose from to make their best five-card hand.

The Play

Figure 2:
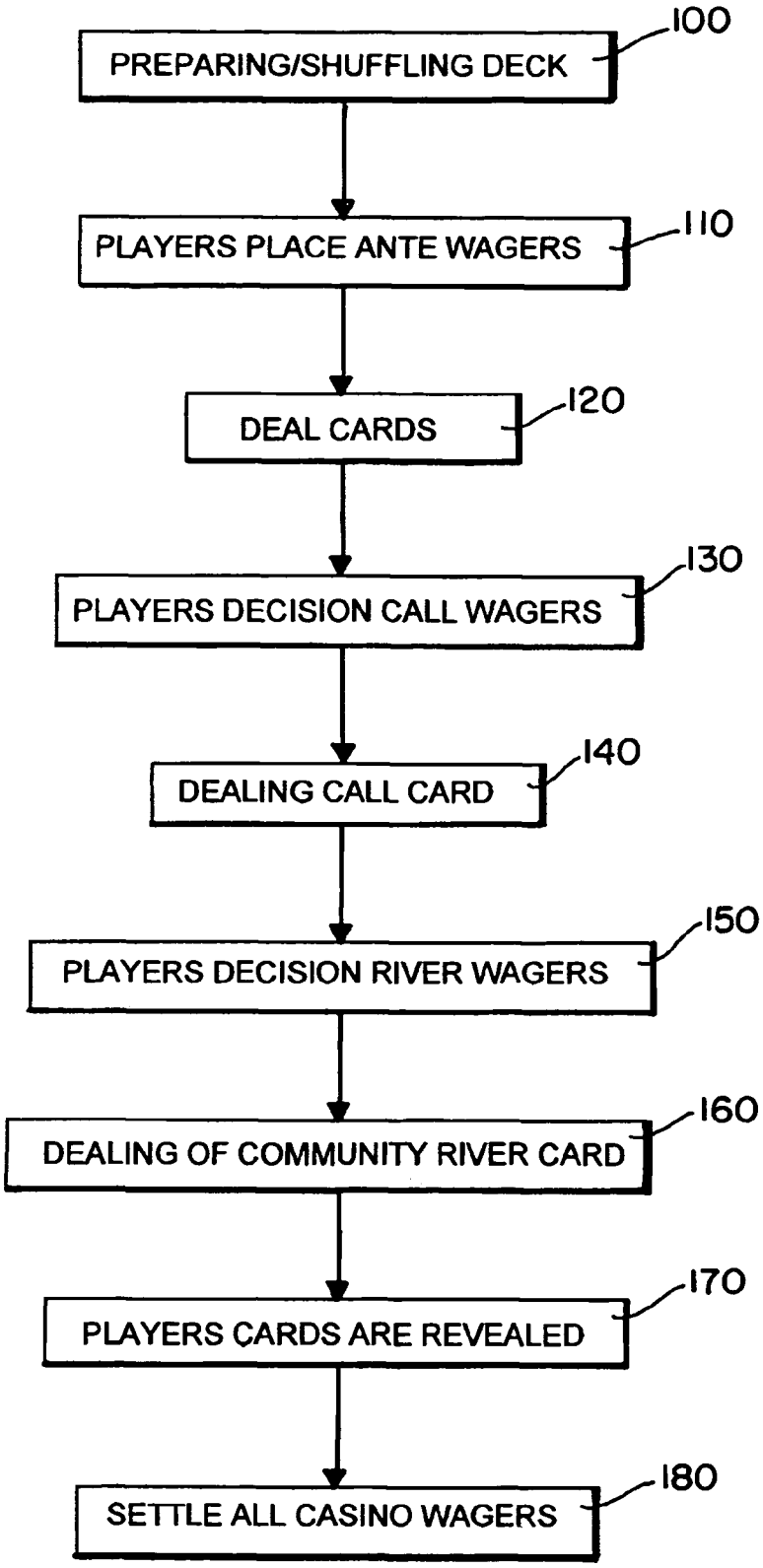
FIG. 2 is a schematic of a preferred method.

FIG. 2 shows a schematic of game play. In step 110, at the start of the game and prior to receiving cards all players place an ante wager preferably in the form of chips, in their ante bet area (symbols 40-40F). In steps 100 and 120, the dealer shuffles the cards and begins dealing a single card to each player face down until all players have been dealt three cards dealt face down. The dealer will then deliver one card to each player face up specifically for that player. All cards are dealt to each player's respective card position (symbols 80 and 85 to 80F and 85F).

At this point each player now has a four-card partial poker hand to make a decision on as indicated in step 130. Each player can: (a) fold and sit out for the remainder of the game thereby surrendering the player's ante bet to the casino or (b) continue play by placing a "call" bet wager (symbol 50 to 50F) and receive an additional card face up specifically for that player in the respected "call" card area (symbol 90 to 90F). Step 140 indicates that the dealer deals each participating player a "call" card which can be dealt face up or face down.

At this point each remaining player (i.e., those who have continued play with a call wager) has a full five-card poker hand to view and make a decision on as indicated by step 150. Each player then makes a final decision to either: (a) fold surrendering the player's "ante" and "call" bets to the casino or (b) continue play by placing a "river" bet in the respected "river" bet area (symbol 60 to 60F). The river bet can be double or equal to the original "ante" bet.

Step 160 indicates that the dealer will then deliver a sixth and final card face up in the respected river card placement area on the table for all remaining players to use (symbol 70). The remaining players now have a total of six cards to make their best five-card poker hand. Steps 170 and 180 indicate that the dealer will then reveal all players' cards and settle all casino wagers.

FIG. 2 illustrates a preferred embodiment of the method of the present invention. In step 100 the dealer prepares and shuffles the deck of cards 190. At the start of each game in step 110 all players place bets in their respective "ante" positions 40-40F. In step 120 players are dealt three cards face down in area 80-80F and one card face up in area 85-85F specifically for that player. In step 130 the player either folds or continues play be placing a "call" bet (which can be double or bet of equal amount to the "ante" bet). In step 140 the dealer now delivers another card to each participating player face up in areas 90-90F specifically for that player. In step 150 the player either folds or continues play by making a "river" bet in the areas 60-60F. The "river" bet can be double or equal to the amount of the original "ante" bets. In step 160 the dealer now delivers a single card face up (a community card) in area 70 for all remaining players to use if needed. Step 170, the dealer reveals all players' cards.

In step 180 all bests are settled and the players have the option of using any six cards to make the best possible five-card poker hand to qualify for the house pay table odds. No matter how many cards are used as community cards or how many cards are dealt to the players, only five cards can be used to make their poker hand. All winning bets will be paid according to the pay table odds and the casino will collect all losing bets. On winning hands the "ante" bet can be paid even money, the "call bets can be paid the house pay table odds, and the "river" bets can be paid the house pay table odds. In the event the player does not make a five-card qualifying poker hand the "ante", "call" and "river" bets will be taken by the casino (positions 40-40F, 50-50F, and 60-60F).

The game River Card Poker is not limited to the above description/procedure with a deal relating to five cards per player. A variation of the deal consists in changing the mix of the number of cards dealt to the players and those that constitute the community cards.

In an alternative embodiment, for any of the above described embodiments, the dealer can also be dealt a dealer hand. In this embodiment, in order for a player to win against the house, the player would have to first beat the dealer's best hand based on the dealer's personal cards and the community cards. If the player beat the dealer's best hand and the player has a winning hand against the house, then the player would be paid based on the player's ante 40, call 50, and river 60 bets. For example, if the dealer's best hand is two pair, the players must at least have a hand which beats the dealer's two pair hand to collect against the house. For example, if the player has a single pair of aces where the dealer has a pair of twos and pair of threes, the player loses and does not collect against the house for his ante, call, and river bets.

Referring to the preferred embodiment of the game River Card Poker, Table A illustrates the potential pay-offs in relation to the list of poker rankings applicable to the game. The house advantage is achieved because exists between the true mathematical odds and the actual pay-off ratios. Those of ordinary skill in the art can calculate appropriate poker rankings for a house advantage. The game can be played by offering odds/pay-offs of a higher or lower order resulting in different edges accruing to the house.

TABLE A

| Payoffs | |
|---|---|
| Best Hand | Pay Table |
| Royal Flush | 200 to 1 |
| Straight Flush | 50 to 1 |
| 4 of a Kind | 10 to 1 |
| Full House | 7 to 1 |
| Flush | 5 to 1 |

TABLE A-continued

| Payoffs | |
|---|---|
| Best Hand | Pay Table |
| Straight | 4 to 1 |
| 3 of a Kind | 3 to 1 |
| 2 Pair | 2 to 1 |
| Queens or Higher | 1 to 1 |

River Card Poker can be adapted and played on a video game machine. Simulated cards are exposed electronically on a display panel/screen. Different rules for playing the game can be applied. In the above examples the pay-table can be adjusted to reflect the probabilities. It is to be understood that the embodiments discussed herein is merely illustrated of the application of the principles of the invention. Numerous modifications may be made therein and other arrangements may be devised without departing from the spirit and scope of the invention.

The following is a list of reference numerals:

LIST FOR REFERENCE NUMERALS

| (Reference No.) | (Description) |
|---|---|
| 10 | Method |
| 15 | Chip Bank |
| 20 | Table |
| 30 | Surface of Table |
| 40 | Ante bet area |
| 50 | Call bet area |
| 60 | River bet area |
| 70 | Community card area |
| 80 | Players face down cards |
| 85 | Players face up card |
| 90 | Players Call Card (face up) |
| 100 | Preparing/shuffling deck |
| 110 | Placing the ante wagers |
| 120 | Dealing of cards |
| 130 | Decision regarding whether to place call wager |
| 140 | Dealing call card |
| 150 | Decision regarding whether to place River wager |
| 160 | Dealing of community river card |
| 170 | Showing of players' cards |
| 180 | Settling all casino wagers |
| 190 | Deck of cards |

It will be understood that each of the elements described above, or two or more together may also find a useful application on other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth on the appended claims. The foregoing embodiments are presented by way of example only: the scope of the present invention is to be limited only by the following claims.

What is claimed is:

1. A method of playing a card game comprising the steps of:

(a) requiring each player to place an ante wager to participate in a wagering game against the house/bank;

(b) providing a physical deck of playing cards and dealing no less than four cards to each player, some face up and some face down;

(c) based on step "b" affording each player the option to place a call wager to continue to participate in the wagering game against the house/bank;

(d) after step "c" dealing only a single additional card to each player who places a call wager;

(e) based on the cards dealt in steps "b" and "d", affording each remaining player the option to place a river wager to continue to participate in the wagering game against the house/bank;

(f) after step (e) dealing only one communal card which all players can use, wherein the total number of cards each player can use consisting of six cards;

(g) after steps "e" and "f" determining a set of winning players based on each player's best five card hand based on the six cards dealt in steps "b", "d", and "f" when compared to a house pay-off table;

(h) after step "g" paying each winning player on an ante wager pay scale for the ante wager;

(i) after step "g" paying each winning player the odds displayed by the call wager house pay table for the call bet depending upon the winning player's poker rank; and (j) after step "g" paying each winning player the odds displayed by the river wager pay table for the river bet depending upon the winning player's poker rank.

2. The method of claim 1, wherein the ante wager pay scale is even money, and the call wager pay table is the same as the river wager pay table.

3. The method of claim 1, wherein the predetermined number of cards dealt to each player numbers four dealt three cards face down and one card face up specifically for that player.

4. The method of claim 1, wherein the number of communal cards dealt is one card dealt face up for all players to use.

5. The method of claim 1, wherein the number of communal cards is one, dealt either face up or face down.

6. The method of claim 1, wherein the amount of the call wager is double that of the ante wager.

7. The method of claim 1, wherein the amount of the call wager is equal to the ante wager.

8. The method of claim 1, wherein the amount of the river wager is double that of the ante wager.

9. The method of claim 1, wherein the amount of the river wager is equal to the ante wager.

10. A method of playing a card game comprising the steps of:

(a) requiring each player to place an ante wager to participate in a wagering game against the house/bank;

(b) providing a physical deck of playing cards and dealing no less than four cards to each player and a dealer, some face up and some face down;

(c) based on step "b" affording each player the option to place a call wager to continue to participate in the wagering game against the house/bank;

(d) after step "c" dealing only a single additional card to each player who places a call wager and dealing a single additional card to the dealer;

(e) based on the cards dealt in steps "b" and "d", affording each remaining player the option to place a river wager to continue to participate in the wagering game against the house/bank;

(f) after step (e) dealing only one communal card which all players and the dealer can use, wherein the total number of cards each player can use consisting of six cards;

(g) after steps "e" and "f" determining a possible set of winning players by comparing each player's best five card hand based on the six cards dealt in steps "b", "d", and "f" to the dealer's best five card hand dealt in steps "b", "d", and "f";

(h) for each player falling within the possible set of winning players of step "g", determining a set of winning players based on each player's best five card hand based on the six cards dealt in steps "b", "d", and "f" when compared to a house pay-off table;

(i) after step "g" paying each winning player on an ante wager pay scale for the ante wager;

(j) after step "g" paying each winning player the odds displayed by the call wager house pay table for the call bet depending upon the winning player's poker rank; and (k) after step "g" paying each winning player the odds displayed by the river wager pay table for the river bet depending upon the winning player's poker rank.

11. The method of claim 10, wherein the ante wager pay scale is even money, and the call wager pay table is the same as the river wager pay table.

12. The method of claim 10, wherein the predetermined number of cards dealt to each player numbers four dealt three cards face down and one card face up specifically for that player.

13. The method of claim 10, wherein the number of communal cards dealt is one card dealt face up for all players to use.

14. The method of claim 10, wherein the amount of the call wager is double that of the ante wager.

15. The method of claim 10, wherein the amount of the call wager is equal to the ante wager.

16. The method of claim 10, wherein the amount of the river wager is double that of the ante wager.

17. The method of claim 10, wherein the amount of the river wager is equal to the ante wager.

18. A method of playing a card game comprising the steps of:

(a) requiring each player to place an ante wager to participate in a wagering game against the house/bank;

(b) providing a physical deck of playing cards and dealing a predetermined number of cards to each player and a dealer, only one face up and some face down;

(c) based on step "b" affording each player the option to place a call wager to continue to participate in the wagering game against the house/bank;

(d) after step "c" dealing only a single additional card to each player who places a call wager and dealing a single additional card to the dealer;

(e) based on the cards dealt in steps "b" and "d", affording each remaining player the option to place a river wager to continue to participate in the wagering game against the house/bank;

(f) after step (e) dealing only one communal card which all players can use, wherein the total number of cards each player can use consisting of six cards;

(g) after steps "e" and "f" determining a possible set of winning players by comparing each player's best five card hand based on the six cards dealt in steps "b", "d", and "f" to the dealer's best five card hand dealt in steps "b", "d", and "f";

(h) for each player falling within the possible set of winning players of step "g", determining a set of winning players based on each player's best five card hand based on the six cards dealt in steps "b", "d", and "f" when compared to a house pay-off table;

(i) after step "g" paying each winning player on an ante wager pay scale for the ante wager;

(j) after step "g" paying each winning player the odds displayed by the call wager house pay table for the call bet depending upon the winning player's poker rank; and (k) after step "g" paying each winning player the odds displayed by the river wager pay table for the river bet depending upon the winning player's poker rank.

19. The method of claim 18 wherein the total number of cards available in step "g" is six cards.

20. The method of claim 18, wherein the ante wager pay scale is even money, and the call wager pay table is the same as the river wager pay table.

21. The method of claim 18, wherein the communal cards dealt is one card dealt face up for all players to use.

22. The method of claim 18, wherein the amount of the call wager is double that of the ante wager.

23. The method of claim 18, wherein the amount of the call wager is equal to the ante wager.

24. The method of claim 18, wherein the amount of the river wager is double that of the ante wager.

25. The method of claim 18, wherein the amount of the river wager is equal to the ante wager.

* * * * *